United States Patent [19]

Nottingham et al.

[11] 4,359,224

[45] Nov. 16, 1982

[54] MANIPULATIVE FLUID-FILLED GAME

[76] Inventors: John R. Nottingham, 4875 Stacy Ct., Richmond Heights, Ohio 44143; John W. Spirk, 2533 Euclid Heights Blvd., Cleveland Heights, Ohio 44106

[21] Appl. No.: 229,147

[22] Filed: Jan. 28, 1981

[51] Int. Cl.[3] ..... A63F 7/04

[52] U.S. Cl. ..... 273/115; 273/1 L

[58] Field of Search ..... 273/1 L, 109–117

[56] References Cited

U.S. PATENT DOCUMENTS

| | | | |
|---|---|---|---|
| 732,312 | 6/1903 | McLeod | 273/109 |
| 806,255 | 12/1905 | Hughes | 273/1 L |
| 1,883,265 | 10/1932 | Wupper | 273/1 L X |
| 2,746,757 | 5/1956 | Frost | 273/1 L |
| 3,406,971 | 10/1968 | Koff | 273/1 L X |
| 3,464,132 | 9/1969 | Matisse | 273/1 L |
| 3,716,233 | 2/1973 | Kotwas et al. | 273/1 L |

FOREIGN PATENT DOCUMENTS

| | | | |
|---|---|---|---|
| 2613 | of 1906 | United Kingdom | 273/109 |

*Primary Examiner*—Paul E. Shapiro

*Attorney, Agent, or Firm*—Yount & Tarolli

[57] ABSTRACT

A hand manipulative game including specially formed fluid chamber, and specially formed objects which must be manipulated into predetermined relation to a target in the chamber. The fluid chamber is formed between a pair of spaced apart translucent walls which are in parallel relation to each other. At least one pair of balls are within the chamber with one ball having a lower specific gravity than the fluid which is to fill the chamber and the other ball having a higher specific gravity than the fluid which is to fill the chamber. The diameter of each of the balls is slightly smaller than the space between the parallel spaced apart walls. Each pair of balls is movable in the fluid chamber in a predetermined relation to the target in order to successfully complete the game.

6 Claims, 12 Drawing Figures

MANIPULATIVE FLUID-FILLED GAME

BACKGROUND OF THE INVENTION

This application relates to a new and useful game including a fluid filled chamber with balls which are heavier and lighter than the fluid (preferably water), and which is hand manipulated to get the balls into predetermined positions relative to a target means in the chamber.

One type of manipulative game involving a water filled chamber is shown in U.S. Pat. No. 806,255. The game comprises a cylindrical chamber filled with water, with two different types of objects in the cylindrical chamber. One type of object has a higher specific gravity than water, and the other has a lower specific gravity than water. There is a target area at one end of the cylindrical chamber for the objects which are heavier than water, and another target area at the other end of the cylindrical chamber for the objects which are lighter than water. The object of the game is to manipulate the cylindrical container to get the heavier objects to their target area and the lighter objects to their target area.

Another type of game in which objects are maneuvered in a water filled chamber is shown in U.S. Pat. No. 4,142,715. In that game the objects are mostly heavier than water, and are projected toward target areas in the water by a current of fluid actuated by a depressable button.

In addition to the foregoing games, there are also other types of structures involving the movement of objects in fluid filled chambers. For example, in U.S. Pat. No. 2,752,725, specially formed three dimensional fluid filled containers contain objects with higher and lower specific gravities then the fluid. THe container and the objects are specifically designed to provide a particular visual effect when the container is manipulated.

SUMMARY OF THE INVENTION

This invention relates to a manipulative game including a specially formed fluid (i.e., water) filled chamber, and specially formed objects which must be manipulated into respective parts of a target means in the chamber in order to successfully complete the game. The game is specially constructed to provide a unique visual impression which increases the difficulty of the game, and requires a high visual and manual dexterity in order to successfully play.

According to the invention, a fluid chamber includes a pair of parallel spaced apart walls and one or more target means are provided in the chamber. At least one pair of balls are provided in the chamber, one having a lower specific gravity than the fluid, the other having a higher specific gravity than the fluid. The pair of balls must be manipulated into predetermined relation to the target means in order to successfully complete the game.

The diameter of the balls is just slightly smaller than the spaced apart distance of the parallel walls. Thus, the motion of the balls takes place within the plane formed by the parallel spaced apart walls. As the game is manipulated, the balls move to one or the other of the parallel spaced apart walls, and effectively roll along the walls. However, to the eye of the person manipulating the game, the balls appear to be moving in two dimensions and in slow motion fashion. With the foregoing construction, it is very difficult for the player to determine which ball is heavier than water, and which is lighter than water, and this increases the dexterity (both visual and manual) which is required to play the game.

In several embodiments according to the invention, the chamber includes a common target area, and both the heavier and lighter balls must be manipulated into a predetermined relation to the common target area in order to successfully complete the game. Such a game requires a particularly acute dexterity in getting both the heavier and lighter balls to the common target area.

In other embodiments according to the invention, the target means includes recesses in each of the parallel spaced apart walls, with each recess being associated with a target area for one ball. The heavier balls are manipulated into recesses in one wall and the lighter balls are manipulated into recesses in the other wall. As stated above, the visual difficulty in identifying the heavier and lighter balls makes it difficult to identify which ball goes with which target area.

In several embodiments of a game according to the invention, tracks or guides are provided on the inside of each of the spaced apart parallel walls. The tracks or guides may define part of the target area itself, or may serve to guide the movement of the balls toward their respective target areas.

Preferably, the difference between the specific gravity of the heavier ball and the specific gravity of the fluid (e.g., water) is greater than the difference between the specific gravity of the lighter ball and the specific gravity of the fluid. Thus, in certain embodiments, particularly those where the balls are manipulated to a common target area, the heavier ball can and will push the lighter ball during the final manipulative stages in order to successfully complete the game, and provide a unique visual effect in so completing the game.

DESCRIPTION OF THE DRAWINGS

The further objects and advantages of the invention will become further apparent from the following detailed description taken with reference to the accompanying drawings wherein.

DETAILED DESCRIPTION OF THE PREFERRED EMBODIMENTS

Figure 1:
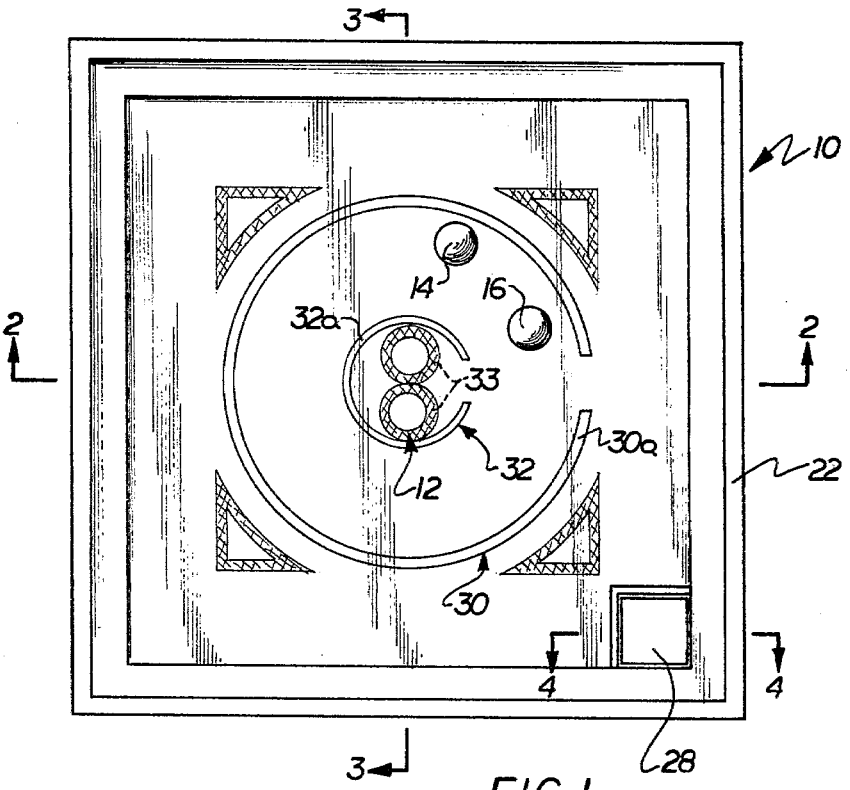
FIG. 1 is a top plan view of a game according to one embodiment of the invention.

FIGS. 1–4 show a water filled game embodying the principles of the invention. Basically, the water filled game comprises a water filled chamber 10, having a target area 12 therein. A pair of balls 14, 16 are in the water filled chamber, with one ball being heavier than water and the other ball being lighter than water. The game is designed to be held in a person's hand, and is manipulated by hand to attempt to get both balls into the target area 12 which, in the embodiment of FIGS. 1–4, comprises the center of a bullseye.

The water filled chamber 10 is basically formed by a pair of walls 18, 20 which are spaced apart and held in parallel relation to each other. The walls 18, 20, are joined together at their outer periphery by a border portion 22 which interlocks with, and is secured to the walls 18, 20. Preferably, the walls 18, 20 and the border portion 22 are formed of plastic, and joined by a sonic welding process, which is well known. Furthermore, one or more posts 24, formed by portions **24*a*, 24*b* which extend inward from the walls 18, 20 and are sonic welded together, help maintain the walls 18, 20** in parallel spaced apart relation.

The spaced apart walls 18, 20 are translucent (preferably clear or transparent) so that the interior of the chamber can be viewed therethrough. Further, one wall (e.g., wall 18) includes an opening 26 for filling the chamber with water, and a stopper 28 is provided for closing the chamber once it is filled with water (see FIG. 4).

In the embodiment of FIGS. 1–4 ball 16 has a specific gravity greater than that of water. Thus, it is heavier than water, and tends to sink in the chamber 10 when the chamber 10 is disposed in the horizontal orientation shown in FIGS. 1–4. It is referred to as the "sinker" ball in this application. The other ball 4 has a specific gravity less than that of water. Thus, the ball 14 is lighter than water and tends to float in the chamber 10, when the chamber 10 is disposed in the horizontal orientation shown in FIGS. 1–4. It is referred to as the "floater" ball in this application.

Figure 2:
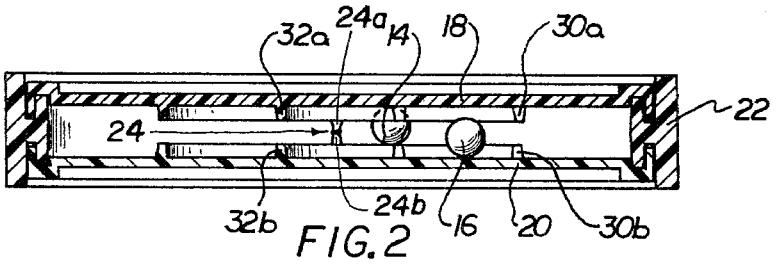
FIG. 2 is a cross sectional view of the game of FIG. 1, taken along the line 2—2.
Figure 3:
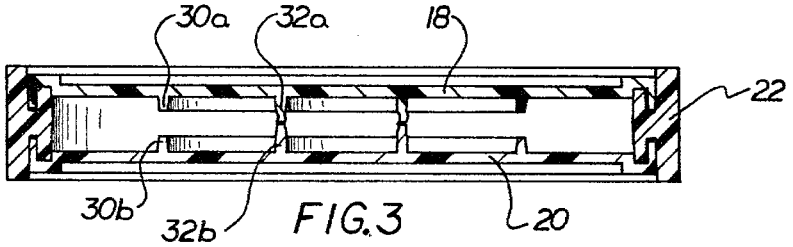
FIG. 3 is a cross sectional view of the game of FIG. 1, taken along the line 3—3.

As seen particularly with respect to FIGS. 2 and 3, the sinker and floater balls have approximately equal diameter, and those diameters are slightly less than the distance that the walls 18, 20 are spaced apart by. For example, the balls 14, 16 preferably each have a diameter of about 0.25 inches and the walls 18, 20 are preferably spaced apart by about 0.33 inches.

As the water filled chamber 10 is manipulated (and unless it is in a vertical plane) the balls 14, 16 tend to move to the spaced apart walls 18, 20 and to roll along the inside of the walls. The sinker and floater balls will naturally move to opposite walls, because of their relative specific gravities to the specific gravity of water.

The relatively close spacing of the walls in relation to the diameter of the balls, and the rolling action of the balls against the inside of the walls 18, 20, gives the balls the appearance of moving in slow motion and essentially in two dimensions, when viewed through the clear walls of the chamber 10. This is important because it requires a high degree of dexterity for one manipulating the game to recognize which ball is the sinker and which is the floater, and this increases the difficulty of the game, and the dexterity required to successfully complete the game.

In the game of FIGS. 1–4, the chamber 10 includes tracks or guides extending inward from each of the walls 18, 20. A pair of arcuate ring portions **30*a*, 30*b* extend inward from walls 18, 20, respectively, and cooperate to form an outer "C" shaped guide ring 30. Another pair of arcuate ring portions 32*a*, 32*b* extend inward from the walls 18, 20, respectively, and cooperate to form an inner "C" guide ring 32 which is concentric with the outer "C" shaped guide ring 30**.

In the game of FIGS. 1–4 inner "C" shaped guide ring 32 defines the bullseye, or common target area 12 for the pair of balls 14, 16. The object of the game is to get both balls 14, 16 into the inner guide ring 32 and thus into the common target area. As seen from FIG. 1, the walls 18, 20 have indicia 33 depicting a pair of circles within the inner "C" shaped guide ring 32. Those circles show the position the balls 14, 16 need to be positioned in within the guide ring 32 to successfully complete the game. The indicia 33 is etched or otherwise formed into the surface of the walls 18, 20 to create a "frosted" type appearance against the clear plastic which forms the walls.

Figure 12:
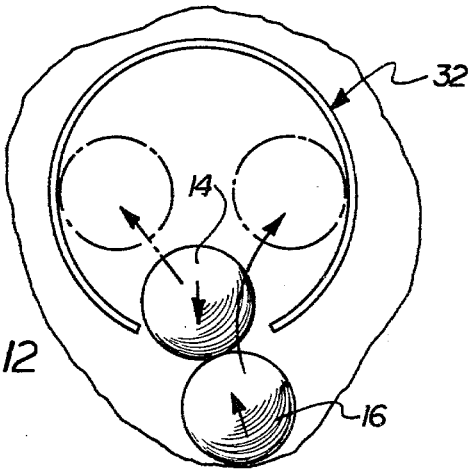
FIG. 12 is a schematic view of part of the game of FIGS. 1-4, showing in full lines the pair of balls during movement to the common target area and showing in dotted lines the final positions of the balls in the common target area.

In FIGS. 1–4 the difference between the specific gravity of the sinker ball and that of water is greater than the difference between the specific gravity of the floater ball and that of water. For example, the sinker ball is preferably formed of acrylic having a 1.14 specific gravity. The floater ball is formed of polypropelene having a 0.91 specific gravity. The importance of this difference in the relative specific gravities of the balls can be seen by reference to the schematic example of FIG. 12. In order to successfully complete the game, it is first necessary to get the balls in a position with the floater ball 14 within the inner guide ring 32 and the sinker ball outside of the inner guide ring 32. The chamber 10 is then flipped over, and due to its relatively heavier composition, the sinker ball forces the floater ball to remain in ring 32 during the final movement, as shown schematically in FIG. 12. When the balls 14, 16 are disposed beneath the frosted circles 33, the game can be stood vertically on one border portion 20, and the balls will remain in place within the inner guide ring 32.

Figure 5:
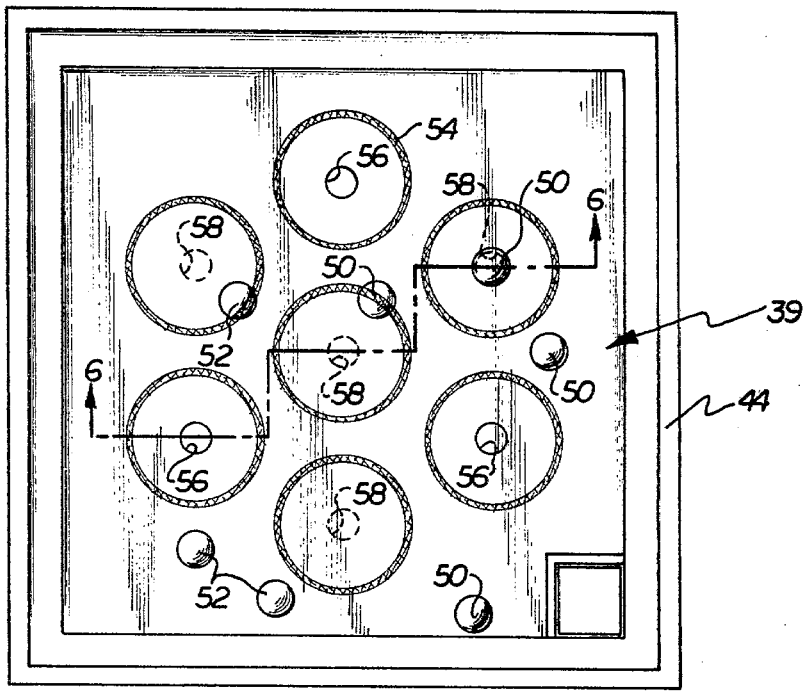
FIG. 5 is a top plan view of another game constructed according to the principles of the invention.
Figure 6:
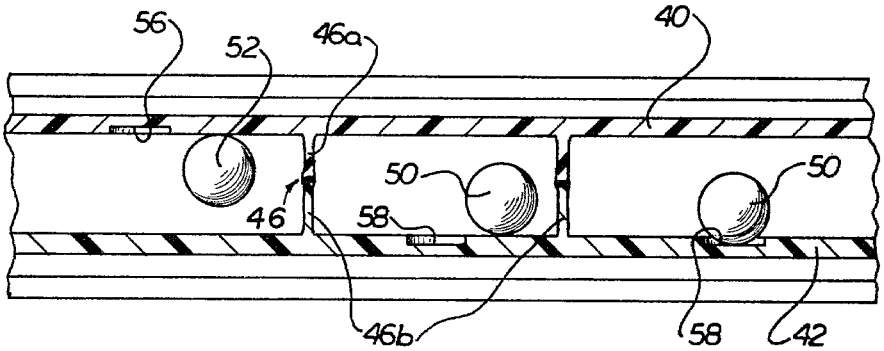
FIG. 6 is a sectional view of the game of FIG. 5, taken along the line 6—6.

FIGS. 5 and 6 show another aspect of a water filled game according to the invention. As with the previous embodiment, the game includes a chamber 39 with spaced apart, parallel, clear plastic walls 40, 42 joined by a border portion 44 in a manner similar to that of the previous embodiment. Further, one or more posts 46, including portions **46*a*, 46*b* extending inward from each of the walls and being joined together, help maintain the walls 40, 42** in parallel spaced apart relation.

In the embodiment of FIGS. 5 and 6, there are a number of balls including both sinkers 50 and floaters 52 in the chamber 39. There are also a plurality of target areas, each being outlined by indicia on the walls forming frosted looking circles 54.

As seen from FIG. 6, the center of each target area includes a recess formed in one wall for receiving and holding one of the balls. One wall 40 has recesses 56 for the floater balls 52, and the other wall has recesses 58 for the sinker balls 50. The object of the game is to position the balls in the centers of the frosted circles 54. Again, as with the previous embodiment, since the balls have a rolling action against the walls 40, 42, and since the balls appear to move in two dimensions, it is difficult to tell which are the sinkers and which are the floaters, and this makes it particularly difficult visually to understand which ball goes to which of the circular target area defined by the frosted circles 54.

Figure 7:
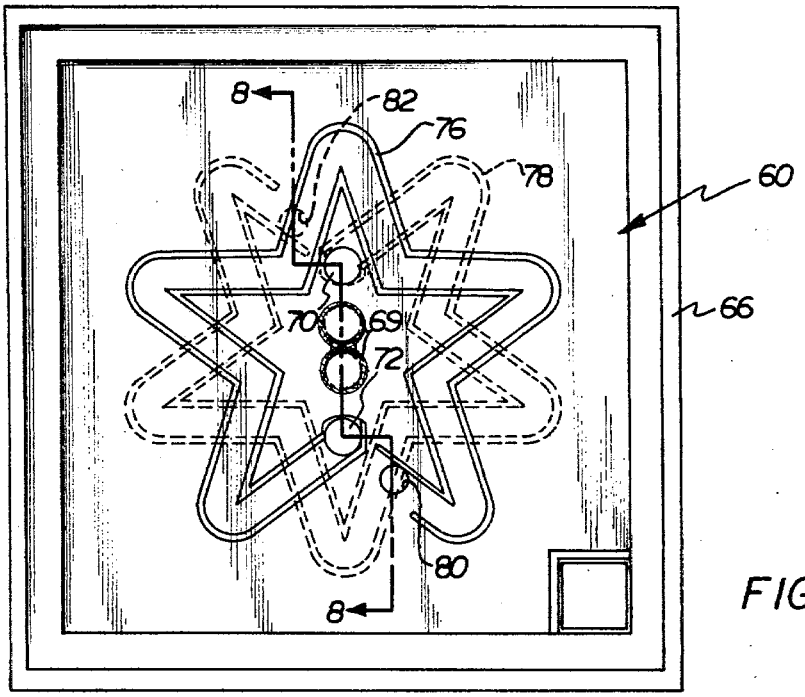
FIG. 7 is a top plan view of still another game constructed according to the principles of the invention.
Figure 8:
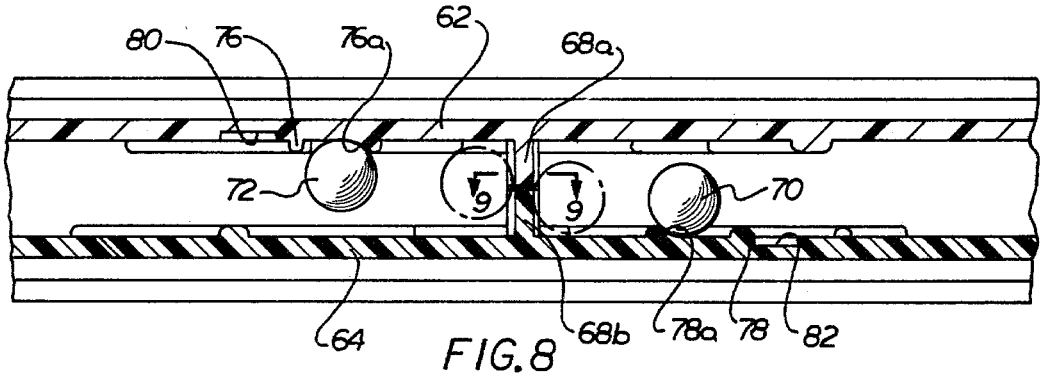
FIG. 8 is a fragmentary sectional view of the game of FIG. 7, taken along the lines 8—8.
Figure 9:
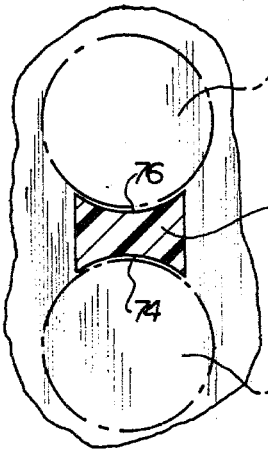
FIG. 9 is a fragmentary sectional view of the game of FIG. 8, taken along the line 9—9 in FIG. 8.

FIGS. 7, 8 and 9 show another aspect of a water filled game according to the invention. As with the previous embodiments, the game includes a chamber 60 formed by spaced apart, parallel, clear plastic walls 62, 64 joined by a border portion 66 in a manner similar to that shown in FIGS. 1-4. Further, a control post 68, including portions 68*a*, 68*b* extending inward from the walls 62, 64 and being joined together help maintain the walls in parallel, spaced apart relation.

In the embodiment of FIGS. 7-9 a sinker ball 70 and a floater ball 72 are disposed in the water filled chamber 60. The central post 68 also functions as the common target area. It includes arcuate surfaces 74, 76 (FIG. 9) against which the balls have to be oriented to successfully complete the game. Indicia forming a pair of frosted looking circles 69 is formed either or both of on the walls 60, 62 to help define the target positions for the balls.

The inside of the walls 60, 62 have star shaped tracks 76, 78 for guiding the balls 70, 72. The track 76 is for guiding the floater ball 72, and the track 78 is for guiding the sinker ball 70. The walls have recesses 80, 82 on their inside surfaces to define the starting positions for the balls 72, 70, respectively. Further, the tracks 76, 78 have respective ramps 76*a*, 78*a* at their ends. In FIG. 7, the tracks, recesses, ramps, indicia, etc. on the inside of wall 62 are shown in full lines, and the tracks, recesses, ramps, indicia on the inside of the other wall 64 are shown in dashed lines.

In completing the game, the balls roll up the ramps 76*a*, 78*a* as they move toward the central post 68. As with the embodiment of FIGS. 1-4, once the game is completed, it can be stood vertically on one of its border portions 66, with the balls 70, 72 against the central post 68.

Figure 10:
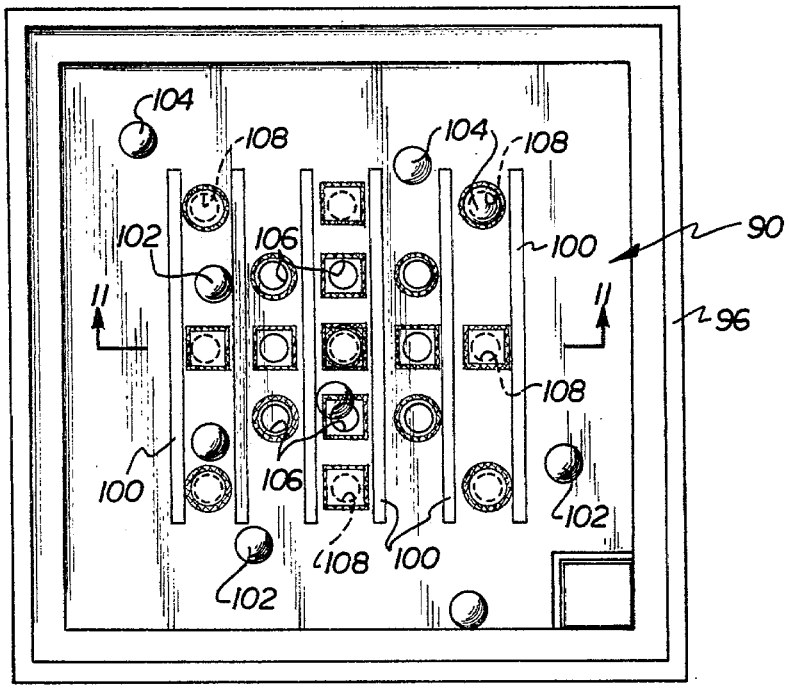
FIG. 10 is a top plan view of another game constructed according to the principles of the invention.
Figure 11:
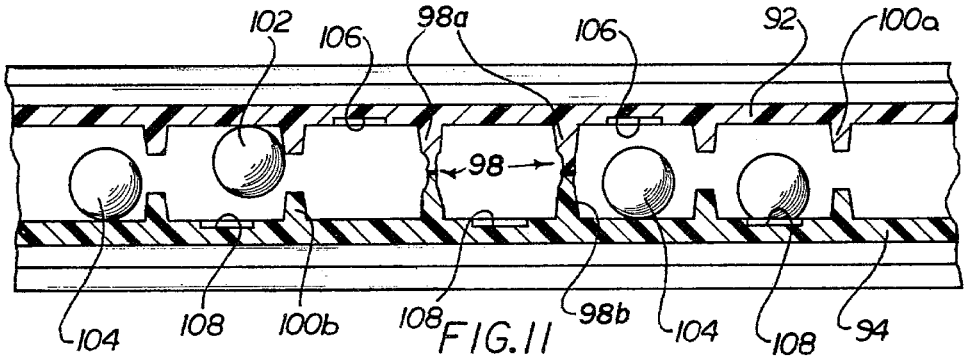
FIG. 11 is a fragmentary sectional view of the game of FIG. 10, taken along the line 11—11.
Figure 4:
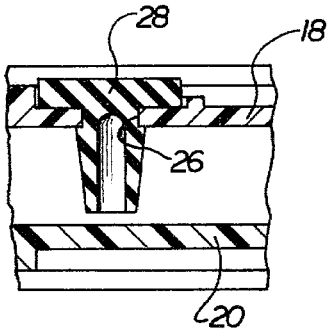
FIG. 4 is a fragmentary sectional view of the game of FIG. 1, taken along the line 4—4.

FIGS. 10 and 11 show still another water filled game according to the invention. As with the previous embodiments, the game includes a chamber 90 formed by spaced apart, parallel, clear plastic walls 92, 94 joined by a border portion 96 in a manner similar to that shown in FIGS. 1-4. Further a plurality of posts 98, including portions 98*a*, 98*b* extending inward from the walls 92, 94, and being joined together, help maintain the walls 92, 94 in parallel, spaced apart relation.

In the game of FIGS. 10 and 11, the walls 92, 94 have straight guide or track portions 100*a*, 100*b*, respectively, extending inward therefrom, and defining straight guides 100.

As with the embodiment of FIGS. 5 and 6, there are a plurality of balls in the chamber, with some balls 102 being floaters and the other balls 104 being sinkers. The walls 92 have target areas including recesses 106 for the floater balls 102 and the wall 94 has target areas including recesses 108 for the sinker balls 104. Further, a series of indicia on the walls 92, 94 depicts frosted looking circles 110 and squares 112 when viewed through the clear plastic walls. FIG. 10 depicts the indicia, recesses, track portions, etc. associated with wall 92 in full lines, and the indicia, recesses, track portions etc. associated with wall 94 in dashed lines.

Preferably, there are nine balls in the chamber 10. The game can be manipulated so that the nine balls are positioned in the frosted circles 110 to form an "X". The game can also be manipulated so that the nine balls are positioned in the frosted squares 112 to form a cross.

Thus, according to the present invention there has been provided a unique fluid filled game requiring high visual and manual dexterity to successfully complete, and a game providing unique visual aspects as it is being manipulated.

What is claimed is:

1. A hand manipulated game comprising a fluid chamber formed between a pair of spaced apart walls which are in parallel relation to each other, a body of fluid filling said chamber, target means in the fluid chamber, at least one pair of balls within the chamber, one ball having a lower specific gravity than the fluid which fills the chamber and the other ball having a higher specific gravity than the fluid which fills the chamber, the diameters of each of the balls being slightly smaller than the spacing between the parallel spaced apart walls, said pair of balls being movable in the fluid chamber into predetermined relation to the target means to successfully complete the game, said parallel spaced apart walls being translucent so that the target means and the movement of the pair of balls in the chamber are visible therethrough as the chamber is manipulated, the ball having a rolling action with respect to the walls, and the motion of the pair of balls being substantially two dimensional when viewed through the translucent spaced apart walls.

2. A hand manipulative game as defined in claim 1 wherein said target means includes a common target area within the fluid chamber, said pair of balls being movable into predetermined relation to the common target area to successfully complete the game.

3. A hand manipulative game as defined in claim 1 wherein said target means includes individual target areas for each ball, each target area including a recess in one of the parallel spaced apart walls.

4. A hand manipulative game as defined in any of claims 1, 2 or 3 including means defining one or more tracks on the inside of each of the parallel spaced apart walls for guiding balls relative to the target means as the game is manipulated.

5. A hand manipulative game as defined in claim 4 wherein the fluid which fills the chamber is water, and wherein the difference between the specific gravity of the heavier ball and the specific gravity of water is greater than the difference between the specific gravity of the lighter ball and the specific gravity of water.

6. A hand manipulative game as defined in any of claims 1, 2 or 3 wherein the fluid which fills the chamber is water, and wherein the difference between the specific gravity of the heavier ball and the specific gravity of water is greater than the difference in the specific gravity of the lighter ball and the specific gravity water.

* * * * *